US008480851B2

(12) United States Patent
Zhou

(10) Patent No.: US 8,480,851 B2
(45) Date of Patent: Jul. 9, 2013

(54) BAMBOO FIBER MATERIAL

(75) Inventor: Mavis Zhou, Wuyishan (CN)

(73) Assignee: Fujian Simzu Environment Science and Technology Co., Ltd., Fujian (CN)

( * ) Notice: Subject to any disclaimer, the term of this patent is extended or adjusted under 35 U.S.C. 154(b) by 58 days.

(21) Appl. No.: 13/148,108

(22) PCT Filed: Aug. 17, 2010

(86) PCT No.: PCT/CN2010/076051

§ 371 (c)(1), (2), (4) Date: Aug. 5, 2011

(87) PCT Pub. No.: WO2011/060652

PCT Pub. Date: May 26, 2011

(65) Prior Publication Data

US 2012/0006500 A1 Jan. 12, 2012

(30) Foreign Application Priority Data

Nov. 23, 2009 (CN) ..... 2009 1 0221974

(51) Int. Cl.
*D21C 5/00* (2006.01)
*A01H 5/02* (2006.01)

(52) U.S. Cl.
USPC ..... 162/94; 162/175

(58) Field of Classification Search
USPC ..... 162/94, 91, 175
See application file for complete search history.

(56) References Cited

FOREIGN PATENT DOCUMENTS

| | | |
|---|---|---|
| CN | 1151883 | 6/1997 |
| CN | 1236725 | 12/1999 |
| CN | 1257089 | 6/2000 |
| CN | 1302718 | 7/2001 |
| CN | 1305933 | 8/2001 |
| CN | 1807711 | 7/2006 |
| CN | 1857882 | 11/2006 |
| CN | 101451318 | 6/2009 |
| CN | 101563991 | 10/2009 |
| CN | 101700667 | 5/2010 |
| JP | 2000071209 | 3/2000 |
| WO | WO2011/060652 | 5/2011 |

OTHER PUBLICATIONS

Machine translation of CN 1807711.*

Machine translation of CN 101451318.*

PCT Appln. Serial No. PCT/CN2010/076051 (WO 2011/060652) filed Aug. 17, 2010, International Search Report, 4 pages (in English and Chinese).

* cited by examiner

*Primary Examiner* — Jacob Thomas Minskey

(74) *Attorney, Agent, or Firm* — Andrew F. Young, Esq.; Lackenbach Siegel, LLP

(57) ABSTRACT

A bamboo fiber material, which is manufactured via the following steps: (1) preparation of bamboo oil: (2) preparation of bamboo fiber: (3) mixing the bamboo oil, a water-proofing agent and sodium chloride, adding water in an amount of 2-5 times of the weight of the mixture, stirring at 15-20° C. for 5-10 minutes; (4) adding the bamboo fiber obtained in step (2), as well as a natural resin powder and an edible starch, stirring at 18-20° C. for 2-5 minutes; finally adding a titanium dioxide and stirring uniformly to obtain the bamboo material. The bamboo fiber material of the present invention is made from natural bamboo as main raw material, taking inherent advantages of bamboo such as antibacterial, anticorrosive, non-toxic and less side-effect. In addition, other raw materials are also all environment-friendly materials, so that the bamboo fiber material is free of volatile chemicals.

9 Claims, No Drawings

BAMBOO FIBER MATERIAL

CROSS REFERENCE TO RELATED APPLICATIONS

This application claims priority from PCT/CN2010/076051 filed Aug. 17, 2010, the contents of which are incorporated herein by reference, and which further claims priority from CH Ser. No. 200910221974.1 filed Nov. 23, 2009.

TECHNICAL FIELD

The present invention relates to a bamboo material, especially to a bamboo fiber material.

BACKGROUND ART

With the rapid development of society, the need for natural wood increases more and more, while the growth cycle of wood is very long relative to the consumption. Since the deterioration of environment draws more and more attention, the lumbering is restricted gradually, and efforts are made to elevate utilization rate of wood and to develop other resources for replacement of wood, such as shaving board, coarse particle board, fine particle board, fiber board made from crop stems, polymer organic material, metal, and so on, which are widely applied in many industries such as building industry, furniture manufacturing industry, packing material, etc.

Bamboo is also an important resource for substituting wood, usually is used for manufacturing furniture, and sometimes in building material, craft and decorative articles as well as daily appliances, while its deep development and utilization are still in studying. At present, as building material, it can be processed to make laminated board, and the technology of making bamboo fiber board as wood substituent by using bamboo fiber as basic material is almost mature. However, the technology for extracting bamboo fiber is still in primary stage. Currently, fine bamboo fiber is generally made by chemical method, which results in that the obtained product contains melamine, while melamine releases toxic substances at high temperature and is not degradable, so that current bamboo fiber products are not ideal environment-friendly products.

CONTENTS OF THE INVENTION

Hence, the object of the present invention is to provide a bamboo fiber material free of harmful chemical substances, which is made from natural bamboo as main raw material and thus is a safe and environment-friendly material.

In order to overcome the above problems, the present invention provides a bamboo fiber material, which is made by the following steps:

(1) preparation of bamboo oil: providing crude bamboo that is mature for 3 years or more, subjecting to high temperature drying treatment, collecting volatile gases, condensing to obtain a liquid as the bamboo oil;

(2) preparation of bamboo fiber:

a) material selection: selecting crude bamboo that is mature for 3 years or more;

b) high-temperature cooking: cooking the crude bamboo at 100° C. for 2-5 hours in order to perform a softening treatment;

c) crushing treatment: subjecting the crude bamboo after the softening treatment to a mechanical grinding treatment, collecting bamboo powder having a particle size of 20-300 meshes;

d) activation of bamboo powder: adding the bamboo oil in a weight amount of 2-5%, stirring at 15-25° C. for 30 minutes to obtain a bamboo fiber;

(3) mixing the bamboo oil, a water-proofing agent and sodium chloride, adding water in an amount of 2-5 times of the weight of the mixture, stirring at 15-20° C. for 5-10 minutes;

(4) adding the bamboo fiber obtained in step (2), as well as a natural resin powder and an edible starch, stirring at 18-20° C. for 2-5 minutes; finally adding a titanium dioxide and stirring uniformly to obtain a bamboo material.

Preferably, the weight parts of the materials used in step (3) and step (4) are as follows:

| | |
|---|---|
| Bamboo fiber | 45-65 |
| Natural resin powder | 20-30 |
| Edible starch | 10-20 |
| Titanium dioxide | 1-3 |
| Bamboo oil | 1-3 |
| Water-proofing agent | 1-3 |
| Sodium chloride | 1-5. |

Preferably, the weight parts of the raw materials are as follows:

| | |
|---|---|
| Bamboo fiber | 55 |
| Natural resin powder | 25 |
| Edible starch | 15 |
| Titanium dioxide | 2 |
| Bamboo oil | 1 |
| Water-proofing agent | 1 |
| Sodium chloride | 1. |

Preferably, in the activation of bamboo powder in step (2), the weight content of the added bamboo oil is 3%.

Preferably, in the activation of bamboo powder in step (2), the stirring rotation speed is 900-1200 rpm.

Preferably, the amount of added water in step (3) is 3 times of the weight of the mixture of former three.

Preferably, the temperature in step (3) is controlled at 18° C.

Preferably, the stirring rotation speed in step (3) is 900 rpm.

Preferably, the stirring time in step (4) is 2 minutes.

As compared to the prior art, the bamboo fiber material of the present invention is made principally from natural bamboo, taking inherent advantages of bamboo such as antibacterial, anticorrosive, non-toxic and less side-effect, and edible starch, sodium chloride, titanium dioxide are also added, so that all materials are environment-friendly materials, and free of volatile chemicals.

The bamboo material of the present invention can be widely used for making various biodegradable containers, such as food containers, non-food containers, as well as shells of various electric appliances, such as air-conditioner, television set, small family electric appliances, including upholsteries, simple laminate, loading board and bench, etc.

SPECIFIC MODES FOR CARRYING OUT THE INVENTION

The present invention is further illustrated in detail by the following examples. However, the description in this part is merely demonstration and explanation, and does not intend to limit the protection scope of the present invention in any way.

Example 1

A bamboo fiber material was made by the following steps:

(1) preparation of bamboo oil: providing crude bamboo that was mature for 3 years or more, subjecting to high temperature drying treatment, collecting volatile gases, condensing to obtain a liquid as the bamboo oil;

(2) preparation of bamboo fiber:

a) material selection: selecting crude bamboo that was mature for 3 years or more;

b) high-temperature cooking: cooking the crude bamboo at 100° C. for 2 hours in order to perform a softening treatment;

c) crushing treatment: subjecting the crude bamboo after the softening treatment to a mechanical grinding treatment, collecting bamboo powder having a particle size of 20-300 meshes;

d) activation of bamboo powder: adding the bamboo oil in a weight amount of 5%, stirring at 15° C. and a rotation speed of 900 rpm for 30 minutes to obtain a bamboo fiber;

(3) mixing the bamboo oil, a water-proofing agent and sodium chloride according to the weight parts thereof, adding water in an amount of 5 times of the weight of the mixture, stirring at 20° C. for 5 minutes;

(4) adding the bamboo fiber obtained in step (2), as well as a natural resin powder and an edible starch, stirring at 18° C. for 5 minutes; finally adding a titanium dioxide and stirring uniformly to obtain a bamboo material;

in which, the weight parts of the materials used in step (3) and step (4) were as follows:

| | |
|---|---|
| Bamboo fiber | 45 |
| Natural resin powder | 30 |
| Edible starch | 10 |
| Titanium dioxide | 3 |
| Bamboo oil | 1 |
| Organosilicon water-proofing agent | 3 |
| Sodium chloride | 1. |

Example 2

A bamboo fiber material was made by the following steps:

(1) preparation of bamboo oil: providing crude bamboo that was mature for 3 years or more, subjecting to high temperature drying treatment, collecting volatile gases, condensing to obtain a liquid as the bamboo oil;

(2) preparation of bamboo fiber:

a) material selection: selecting crude bamboo that was mature for 3 years or more;

b) high-temperature cooking: cooking the crude bamboo at 100° C. for 5 hours in order to perform a softening treatment;

c) crushing treatment: subjecting the crude bamboo after the softening treatment to a mechanical grinding treatment, collecting bamboo powder having a particle size of 20-300 meshes;

d) activation of bamboo powder: adding the bamboo oil in a weight amount of 2%, stirring at 25° C. and a rotation speed of 1200 rpm for 30 minutes to obtain a bamboo fiber;

(3) mixing the bamboo oil, a water-proofing agent and sodium chloride according to the weight parts thereof, adding water in an amount of 2 times of the weight of the mixture, stirring at 15° C. and 1000 rpm for 10 minutes;

(4) adding the bamboo fiber obtained in step (2), as well as a natural resin powder and an edible starch, stirring at 20° C. for 2 minutes; finally adding a titanium dioxide and stirring uniformly to obtain a bamboo material;

in which, the weight parts of the materials used in step (3) and step (4) were as follows:

| | |
|---|---|
| Bamboo fiber | 65 |
| Natural resin powder | 20 |
| Edible starch | 20 |
| Titanium dioxide | 1 |
| Bamboo oil | 3 |
| Water-proofing balm | 1 |
| Sodium chloride | 5. |

Example 3

A bamboo fiber material was made by the following steps:

(1) preparation of bamboo oil: providing crude bamboo that was mature for 3 years or more, subjecting to high temperature drying treatment, collecting volatile gases, condensing to obtain a liquid as the bamboo oil;

(2) preparation of bamboo fiber:

a) material selection: selecting crude bamboo that was mature for 3 years or more;

b) high-temperature cooking: cooking the crude bamboo at 100° C. for 4 hours in order to perform a softening treatment;

c) crushing treatment: subjecting the crude bamboo after the softening treatment to a mechanical grinding treatment, collecting bamboo powder having a particle size of 20-300 meshes;

d) activation of bamboo powder: adding the bamboo oil in a weight amount of 3%, stirring at 20° C. and a rotation speed of 1000 rpm for 30 minutes to obtain a bamboo fiber;

(3) mixing the bamboo oil, a water-proofing agent and sodium chloride according to the weight parts thereof, adding water in an amount of 3 times of the weight of the mixture, stirring at 18° C. and 900 rpm for 8 minutes;

(4) adding the bamboo fiber obtained in step (2), as well as a natural resin powder and an edible starch, stirring at 19° C. for 2 minutes; finally adding a titanium dioxide and stirring uniformly to obtain a bamboo material;

in which, the weight parts of the materials used in step (3) and step (4) were as follows:

| | |
|---|---|
| Bamboo fiber | 55 |
| Natural resin powder | 25 |
| Edible starch | 15 |
| Titanium dioxide | 2 |
| Bamboo oil | 1 |
| Polyurethane | 1 |
| Sodium chloride | 1. |

Product Test Example

1. Assay of Pentachlorophenol 1.1 Assaying pentachlorophenol in the bamboo fiber materials obtained in the above examples according to the FDA method of U.S.A;

1.2 Performing the assay by using GC-ECD method according to the regulations of FDA 21 CFR 178.3800;

1.3 Assay results, as shown in the below table:

| Item | Result | Assay limit (mg/Kg) | Maximum allowable value (mg/Kg) |
|---|---|---|---|
| Example 1 | 0.3 | 0.35 | 50 |
| Example 2 | 0.4 | 0.42 | 50 |
| Example 3 | 0.2 | 0.30 | 50 |

2. Assay of Formaldehyde 2.1 Assaying by using UV/Vis spectrophotometry according to German BS EN 1541:2001;

2.2 Results, as shown in the below table:

| Item | Result ($mg/dm^2$) | Maximum allowable value ($mg/dm^2$) |
|---|---|---|
| Example 1 | 0.6 | 1 |
| Example 2 | 0.5 | 1 |
| Example 3 | 0.7 | 1 |

3. Determination of Melamine Specific Transfer Rate 3.1 Determining by using HPLC-MS method and selecting simulation liquid and transfer conditions according to European EN13130-1: 2004;

3.2 Results, as shown in the below table:

| Item | Result (mg/kg) | Maximum allowable value (mg/kg) |
|---|---|---|
| Example 1 | 0.2 | 30 |
| Example 2 | 0.1 | 30 |
| Example 3 | 0.1 | 30 |

The assay results of pentachlorophenol, formaldehyde and melamine clearly showed that the bamboo fiber materials of the present invention were far less than the prescribed values for this kind of product (in which the content of pentachlorophenol was far less than the allowable value, the content of formaldehyde was close to 50% of the allowable value, and the content of melamine was far less than the allowable value), which indicated that the bamboo fiber materials of the present invention were non-toxic and free of volatile chemicals.

The bamboo material of the present invention can be used in various containers, shells of electric appliances to replace plastics; and can be widely used for making various degradable containers, such as food containers, non-food containers, as well as shells of various electric appliances, such as air-conditioner, television set, small family electric appliances, including upholsteries, simple laminate, loading board and bench, etc.

The method for making various containers or shells of electric appliances comprises: 1) placing a mixed bamboo fiber material powder into a set of model with equivalent volume, the upper and lower models having a temperature difference of 3%, subjecting to equivalent extrusion flow and molding to produce a workblank; 2) finishing and polishing the surface of the workblank according to requirements of various products.

The bamboo material of the present invention is made from natural raw material via steps such as grinding, modeled by pressure forming to finally obtain bamboo fiber products such as food or non-food containers that meet the Sanitation Standard for Food Utensils, Containers and Packages (DOH Food No. 0940405538 (Amended) (卫署食字第 0940405538 号令修正)) and the Methods for Testing Food Utensils, Containers and Packages (DOH Food No. 0939315623 (Amended), CNS11820, (署授食字第 0939315623 公告修正 CNS11820)).

All three types of products, i.e., natural color, color and appliqué products, made from the bamboo fiber material of the present invention meet the following standards: good uniformity of material, free of chromatic error, free of spot on surface, no deformity in product; as for appliqué products, appliqué an decals having no wrinkling, no gas bubble and surface crack, appliqué products having clear pattern and good glossiness as well as symmetric thickness, polishing parts having no black contamination residues; the results of physical and mechanical tests meeting the national standards, the dishwasher test showing good low-temperature tolerance (capable of keeping at −20° C. for 1 hour), the products having no discolouring, no rupture, and no breaking when falling down from a height of 80 cm at room temperature.

The aforementioned gives some preferable embodiments of the present invention. It should be noted that an ordinary technician in the art can make further improvements and modifications without departing from the principle of the present invention, and all these improvements and modifications should also be deemed as pertaining to the protection scope of the present invention.

What is claimed is:

1. A method for making a bamboo fiber material, said method comprising the steps of:

(1) preparing bamboo oil by providing a first crude bamboo that is mature for three (3) years or more, subjecting the first crude bamboo to high temperature drying treatment, collecting volatile gases, and condensing the volatile gases to obtain a liquid as the bamboo oil;

(2) preparing a bamboo fiber by:

a) selecting a second crude bamboo that is mature for three (3) years or more;

b) cooking the second crude bamboo at a temperature of 100° C. for two to five (2-5) hours to perform a softening treatment;

c) subjecting the second crude bamboo after the softening treatment to a mechanical grinding treatment, and collecting bamboo powder having a particle size of twenty to three hundred (20-300) meshes; and d) activating the bamboo powder by adding the bamboo oil in a % weight amount of two to five percent (2-5%), and stirring at fifteen to twenty-five degrees Celcius (15-25° C.) for thirty (30) minutes to obtain a bamboo fiber;

(3) mixing the bamboo oil, a water-proofing agent and sodium chloride, and adding water in an amount of two to five (2-5) times the weight of the mixture of the bamboo oil, a water-proofing agent and sodium chloride, stirring at a temperature of fifteen to twenty degrees Celcius (15-20° C.) for a time of five to ten (5-10) minutes;

(4) adding the bamboo fiber obtained in step (2), a natural resin powder and an edible starch, stirring at a temperature of eighteen to twenty degrees Celcius (18-20° C.) for a time of two to five (2-5) minutes; and (5) adding a titanium dioxide and stirring uniformly to obtain the bamboo fiber material.

2. The method material according to claim 1, wherein weight parts by % of the materials used in step (3) and step (4) are as follows:

| | |
|---|---|
| Bamboo fiber | 45-65%; |
| Natural resin powder | 20-30%; |
| Edible starch | 10-20%; |
| Titanium dioxide | 1-3%; |
| Bamboo oil | 1-3%; |
| Water-proofing agent | 1-3%; and |
| Sodium chloride | 1-5%. |

3. The method according to claim 1, wherein weight parts by % of materials used in step (3) and step (4) are as follows:

| | |
|---|---|
| Bamboo fiber | 55%; |
| Natural resin powder | 25%; |
| Edible starch | 15%; |

-continued

| | |
|---|---|
| Titanium dioxide | 2%; |
| Bamboo oil | 1%; |
| Water-proofing agent | 1%; and |
| Sodium chloride | 1%. |

4. The method according to claim 1, wherein during the activating of the bamboo powder in step (2), the % weight amount of the added bamboo oil is 3%.

5. The method according to claim 1, wherein during the activating of the bamboo powder in step (2), a stirring rotation speed of nine hundred to twelve hundred rotations per minute (900-1200 rpm) is used.

6. The method according to claim 1, wherein the amount of added water in step (3) is three (3) times the weight by % of the mixture of the bamboo oil, a water-proofing agent and sodium chloride.

7. The method according to claim 1, wherein the temperature in step (3) is controlled at 18° C.

8. The method according to claim 1, wherein a stirring rotation speed of nine hundred rotations per minute (900 rpm) is used in step (3).

9. The method according to claim 1, wherein the stirring time in step (4) is two (2) minutes.

* * * * *